US007334693B2

(12) United States Patent
Müller et al.

(10) Patent No.: US 7,334,693 B2
(45) Date of Patent: Feb. 26, 2008

(54) BIASED SUPPORT

(75) Inventors: Conrad Müller, Zell am Main (DE); Alexander Hoffmann, Veitshöchheim (DE); Manfred Schmitt, Bad Kissingen (DE)

(73) Assignee: Noell Crane Systems GmbH, Würzburg (DE)

( * ) Notice: Subject to any disclaimer, the term of this patent is extended or adjusted under 35 U.S.C. 154(b) by 0 days.

(21) Appl. No.: 11/724,755

(22) Filed: Mar. 16, 2007

(65) Prior Publication Data

US 2007/0227997 A1 Oct. 4, 2007

(30) Foreign Application Priority Data

Mar. 31, 2006 (DE) ..... 10 2006 015 431

(51) Int. Cl.
*B66C 5/00* (2006.01)

(52) U.S. Cl. ..... 212/325; 212/312

(58) Field of Classification Search ..... 212/312, 212/314, 325
See application file for complete search history.

(56) References Cited

U.S. PATENT DOCUMENTS

| | | | | |
|---|---|---|---|---|
| 802,134 | A * | 10/1905 | Brown | 212/73 |
| 1,643,642 | A * | 9/1927 | Phillips | 104/98 |
| 3,074,563 | A * | 1/1963 | Montgomery | 212/294 |
| 6,082,562 | A * | 7/2000 | Riikonen | 212/312 |

FOREIGN PATENT DOCUMENTS

DE 102 39 565 A1 3/2004

* cited by examiner

*Primary Examiner*—Thomas J Brahan
(74) *Attorney, Agent, or Firm*—Collard & Roe, P.C.

(57) ABSTRACT

A biased support for booms that can pivot about a pin, for pivoting travel tracks for vehicles that run on rails, such as trolley travel tracks on booms. The booms are mounted to pivot via pins, the lock on the boom and slide plates on the upper and lower bearing points of the lock. At least one of the two slide plates in the upper bearing point is mounted elastically, so that when the boom is pivoted into the operating position, the entire lock is biased vertically and the pin is relieved of stress.

9 Claims, 9 Drawing Sheets

BIASED SUPPORT

BACKGROUND OF THE INVENTION

1. Field of the Invention

The invention relates to a biased support for booms that can pivot about a pin, for pivoting travel tracks for vehicles that run on rails, such as trolley travel tracks on booms. The invention can be used anywhere where travel tracks of vehicles that run on rails, particularly crane trolleys, which run on a divided (joined) travel track during their operation and must pass over this travel track join, are present.

2. The Prior Art

Such travel tracks can be disposed on cranes, for example portal cranes such as container cranes, bridge cranes, or the like. These cranes have the bridge part with a horizontal travel track for the trolley on the crane, and a foldable travel beam that is disposed to rotate in a bearing, about an axis. A boom lock that absorbs forces between travel beam and crane connects the bridge part with the boom. Slide plates with which the travel beam moves into the crane part are disposed on the boom lock.

Such a bearing is described, for example, in German Patent No. DE 102 39 565 A1, whereby the travel tracks over the boom lock was not described.

Typically, the movable part of the travel tracks, which can be situated on a folding boom, are vertically supported in their operating position, i.e., in a horizontal position, by means of a type of support. The vertical forces from the weight of the boom itself and of the vehicle that runs on it, for example a crane trolley, is transferred from the fixed part to the movable part of the travel track not by way of the pin of the boom joint, but rather by way of the rigidly mounted slide plates. For this purpose, the boom lock described above was created for the operating position of the boom, which lock consists of an upper bearing point having an upper and lower slide plate, and a lower bearing point having an upper and lower slide plate. In connection with the construction and function of such a lock-like connection, the slide plates and their infrastructure are usually mounted in an approximately stress-free manner, since the weight force of the boom during pivoting into the horizontal position and accordingly also in the horizontal position are not transferred exclusively by way of the joint pin.

If the connection between the fixed and movable parts of the travel track is now stressed by a changeable load, for example a traveling crane trolley, the joint pin will deform, along with its bearing, and the entire infrastructure up to the travel track, before pressure stress is placed on the slide plates. This deformation of the component lying in the force flow results in a vertical displacement of the two rail ends, resulting in premature wear and poor operating behavior.

SUMMARY OF THE INVENTION

It is therefore an object of the invention to minimize the elastic deformation of the fixed and moving parts of the travel track of a vehicle that runs on rails, in the region of the rail join between the fixed and movable parts, in order to achieve as impact-free a transition as possible of the running wheel from the fixed to the movable part of the travel track.

This task is accomplished according to the invention by a biased support for booms that can pivot about a pin, preferably for pivoting travel tracks for vehicles that run on rails, such as trolley travel tracks on booms. The booms are mounted to pivot by means of pins, the lock on the boom and slide plates between the upper and lower bearing point of the lock. At least one of the two slide plates in the upper bearing point is mounted elastically, so that when the boom is pivoted into the operating position, the entire lock is biased vertically and the pin is relieved of stress.

The solution according to the invention provides that the slide plates of the upper bearing point are mounted in such a manner that when the boom is pivoted into the operating position, the entire boom lock is vertically biased, and this results in stress relief for the boom pin.

At least one of the slide plates of the upper bearing point is attached to an elastic substratum. An elastic substratum can be achieved by a spring, i.e. a metal spring, or a spring made of an elastic material. It is advantageous that the embodiment can also be implemented by way of a motor-driven helical spindle or a hydraulic biasing device.

In this embodiment, the lower support can fundamentally be left out, and the boom pin is used as a counter-bearing.

It is possible to mount both upper slide plates elastically, or only one of the two, for example the upper or the lower slide plate.

In the case of mounting of the lower slide plate of the upper bearing point on an elastic substratum or a mechanical spring, the slide plate must be installed with excess dimensions, so that the elastic substratum is deformed when it is moved into the operating position, and can apply a defined force. The forces in the lower bearing, which result from the bias of the upper bearing, are greater than the forces from the proportional weight force from the boom and the trolley situated on it, so that the lower bearing cannot open in the operating position, i.e. in the horizontal position and with the vertical loads from the proportional inherent weight of the movable part of the travel track and the trolley. All of the other slide plates, which are not mounted elastically, are mounted rigidly.

It is advantageous if at least all of the upper slide plates have a convex contact surface that follows a cylinder shape, with which they support themselves on the lower slide plates 13. The radius of the cylinder is preferably equal to the distance from the center of the boom pin to the contact surface of the pair of slide plates, in each instance.

It is also advantageous to provide the lower slide plates with a convex contact surface that follows a cylinder shape, so that surface contact results when the upper and lower slide plates touch one another. The slide plates are preferably produced from a material resistant to friction wear and, to the extent that the selection of the material makes this necessary, are lubricated. For this purpose, it is advantageous that devices for introducing lubricants into or onto the slide plates are present.

The invention has the advantage that a step-free or join-free transition between the travel tracks is present, resulting in low-noise running of wheels and low wear.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
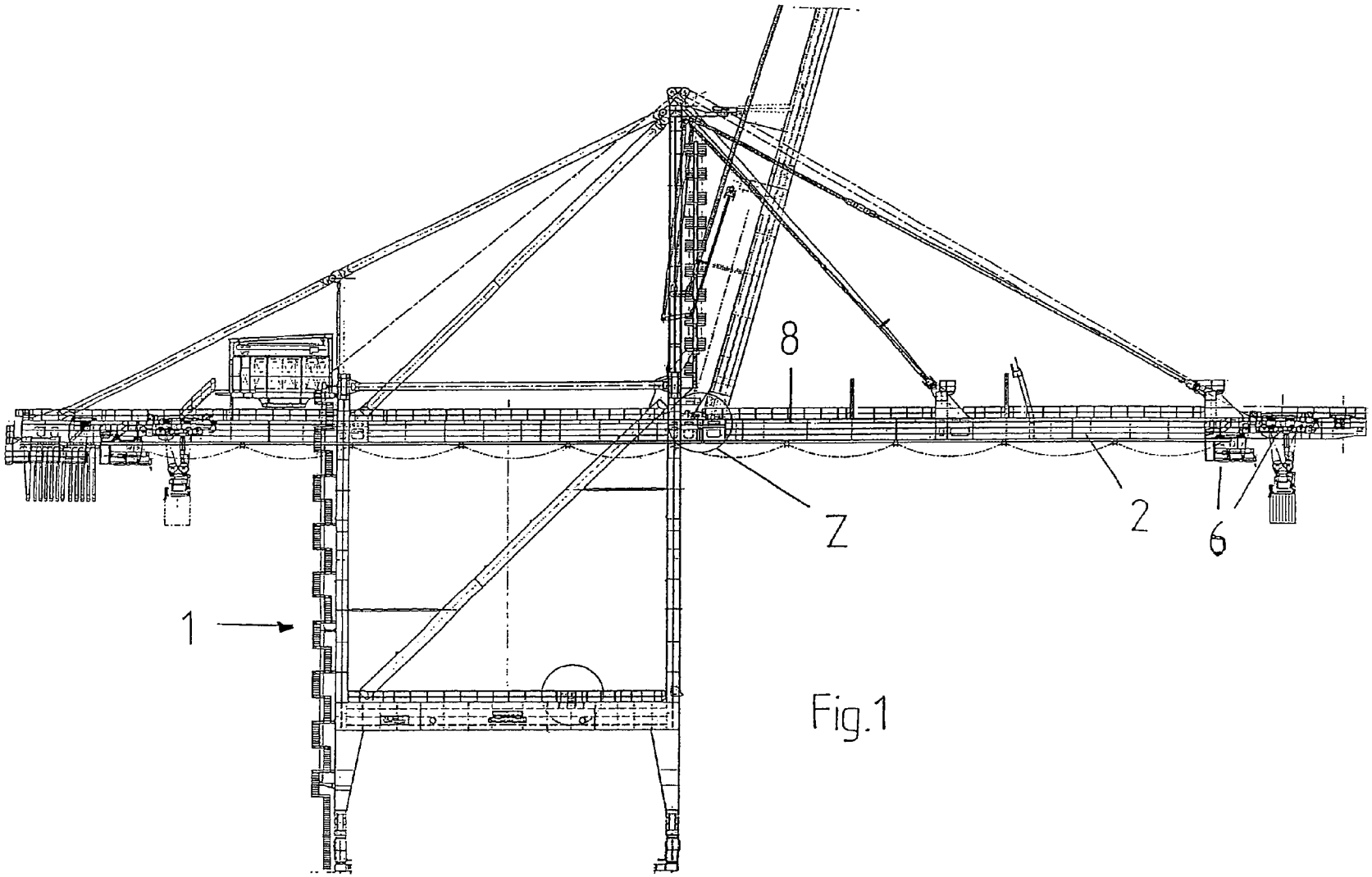
FIG. 1 shows a crane with a boom according to the invention.

Referring now in detail to the drawings FIG. 1 shows a container crane 1 with its land-side part, on which a boom 2 is disposed, and trolley 6 is situated. Trolley 6 moves on travel tracks 8 on boom 2 and the upper part of crane 1. The boom lock shown as Detail Z is disposed between boom 2 and crane 1.

Figure 3:
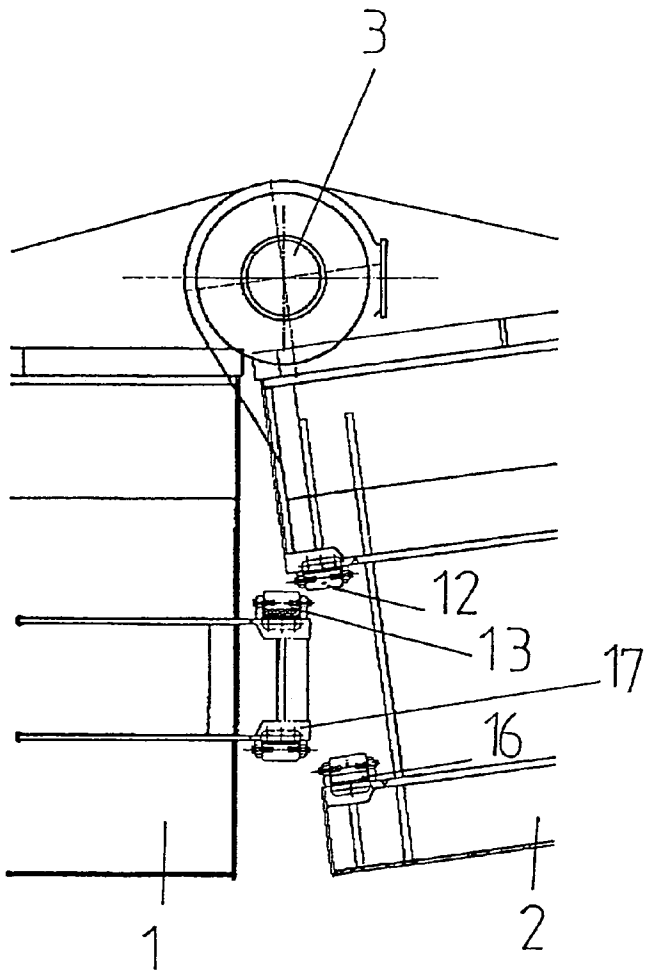
FIG. 3 shows a detail Z from FIG. 1 with the boom open.
Figure 2:
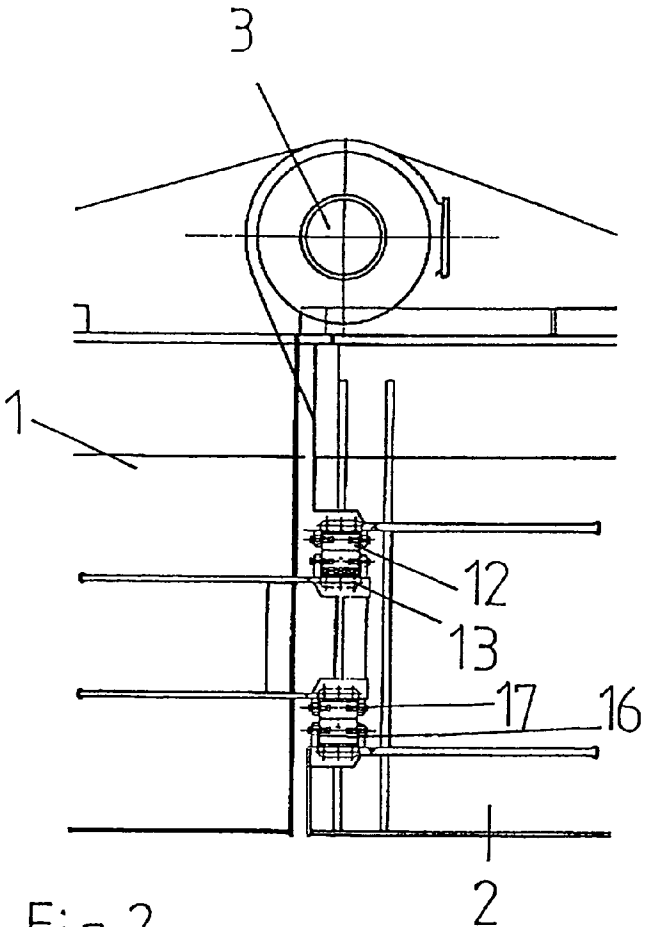
FIG. 2 shows a detail Z from FIG. 1 with the boom closed.
Figure 7:
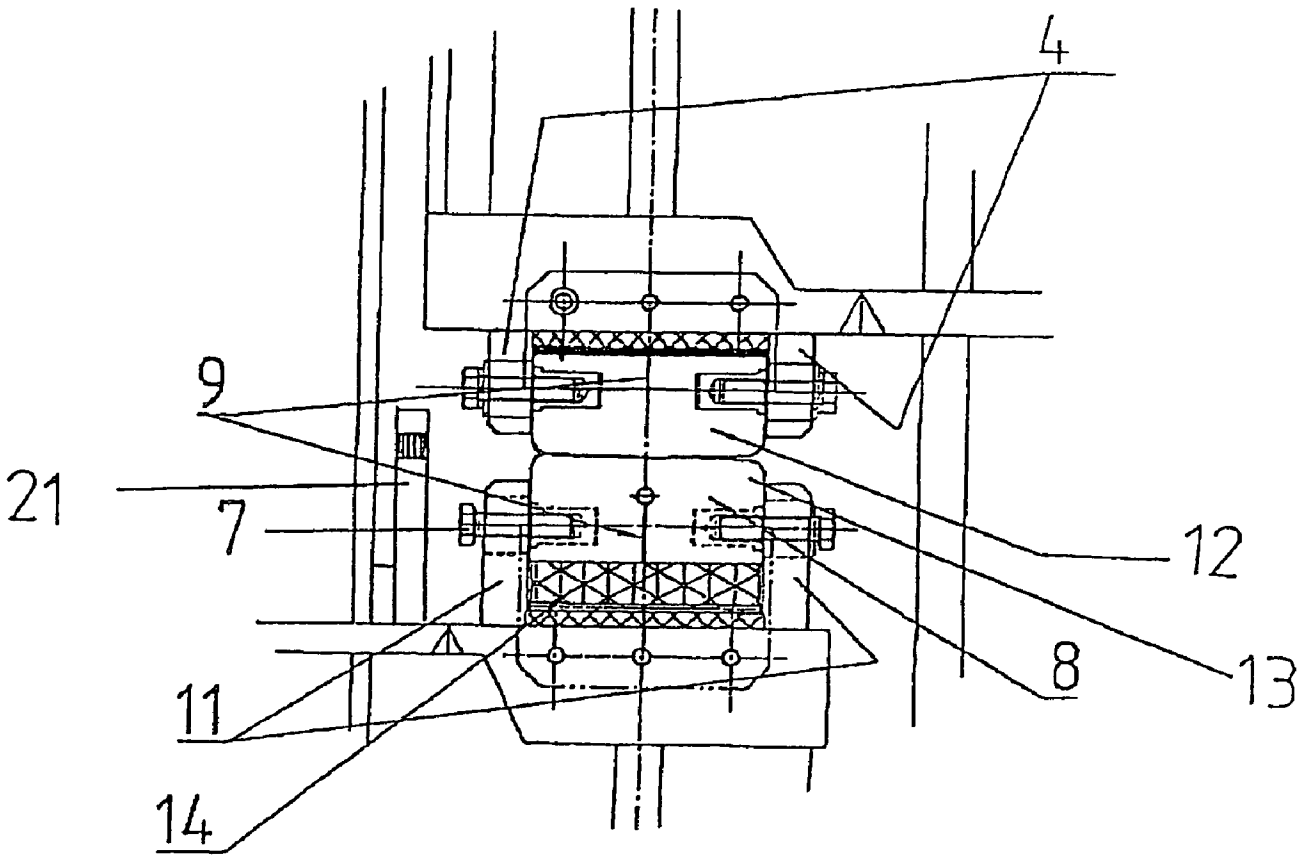
FIG. 7 shows a lubricant device according to the invention.
Figure 8:
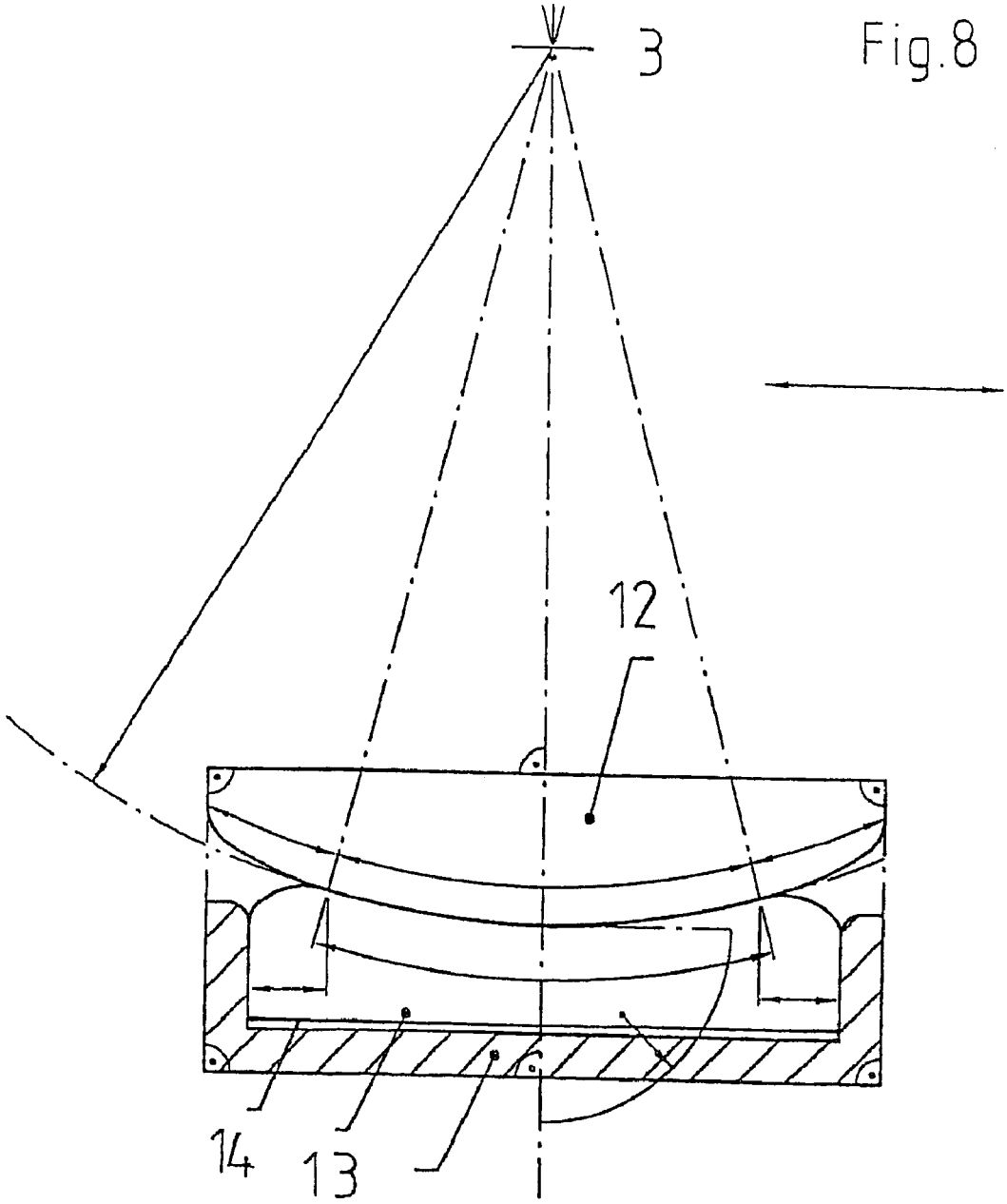
FIG. 8 shows the spacing and shape of the slide plates.

Detail Z is shown in FIGS. 2 and 3, both with boom 2 closed and with boom 2 open. The boom joint with pin 3 is disposed between boom 2 and crane 1. On boom 2, upper slide plate 12 is attached in the upper bearing point, and lower slide plate 16 in the lower bearing point. On crane 1 lower slide plate 13 is attached in the upper bearing point, and upper slide plate 17 in the lower bearing point. The attachments of slide plates 12, 13, 16, 17 are shown in greater detail in FIGS. 4 and 5. As shown in FIG. 8, it is advantageous if at least all of the upper slide plates 12 have a convex contact surface that follows a cylinder shape, with which they support themselves on the lower slide plates 13. The radius of the cylinder is preferably equal to the distance from the center of the boom pin 3 to the contact surface of the pair of slide plates 12, 13, in each instance. As shown in FIG. 7, there can be lubricating devices 21 for lubricating slide plates 12 and 13.

Figure 4:
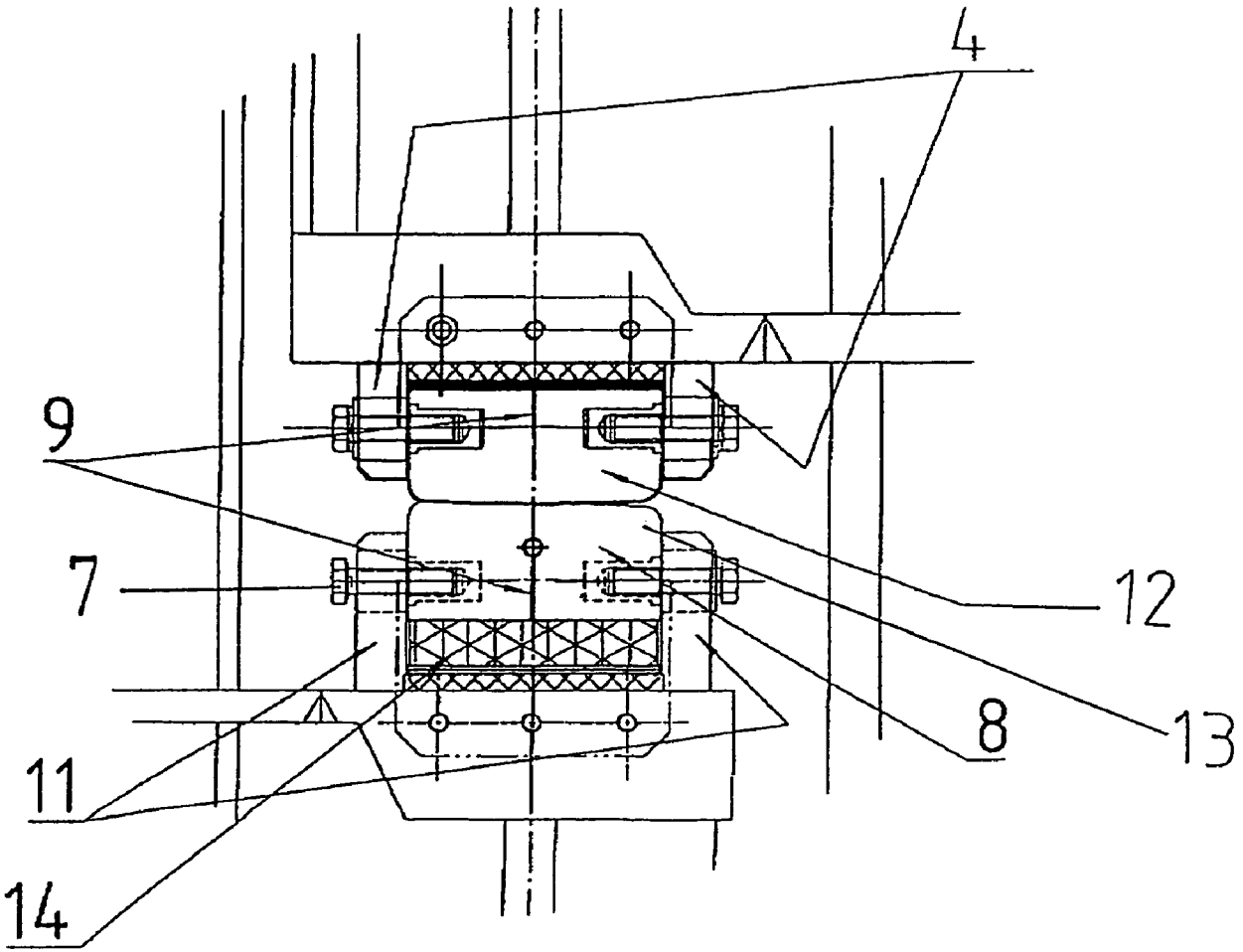
FIG. 4 shows an upper part of the boom lock.

FIG. 4 shows the upper part of the boom lock, in which a spring element 14 is disposed between the support and lower slide plate 13. Spring element 14 shown is a compressible steel-reinforced rubber plate. The two slide plates 12, 13 are attached in their bearings by means of thrust blocks 11, 4 and screws 7. Upper slide plate 12 in the upper bearing point has no spring mounting.

Figure 5:
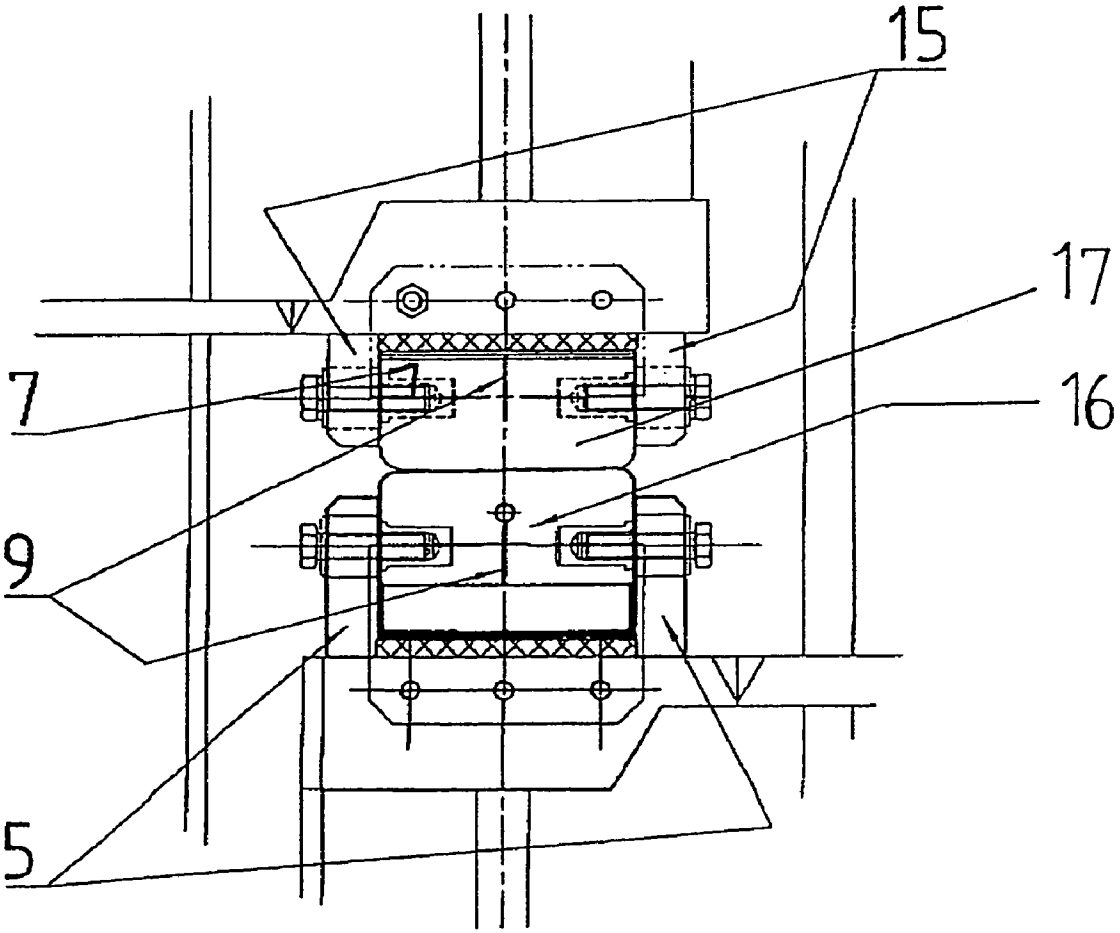
FIG. 5 shows a lower part of the boom lock.

FIG. 5 shows slide plates 16, 17 of the lower part of the boom lock, which are attached with thrust blocks 15, 5 and screws 7. Scribe marks 9 for slide plates 12, 13, 16, 17 are drawn on FIGS. 4 and 5.

Figure 6:
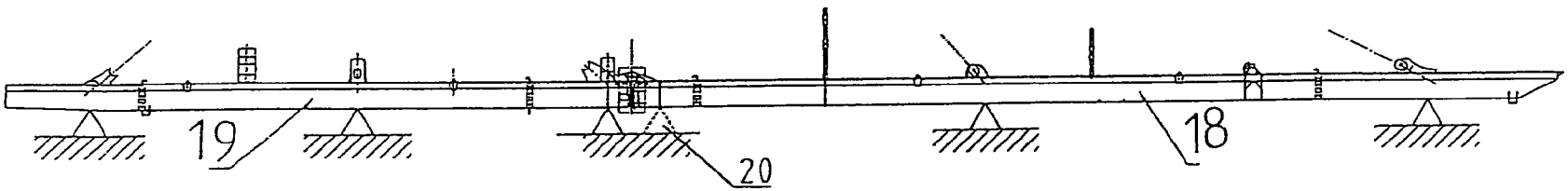
FIG. 6 shows a crane track beam with crane and boom part on support parts.
Figure 9:
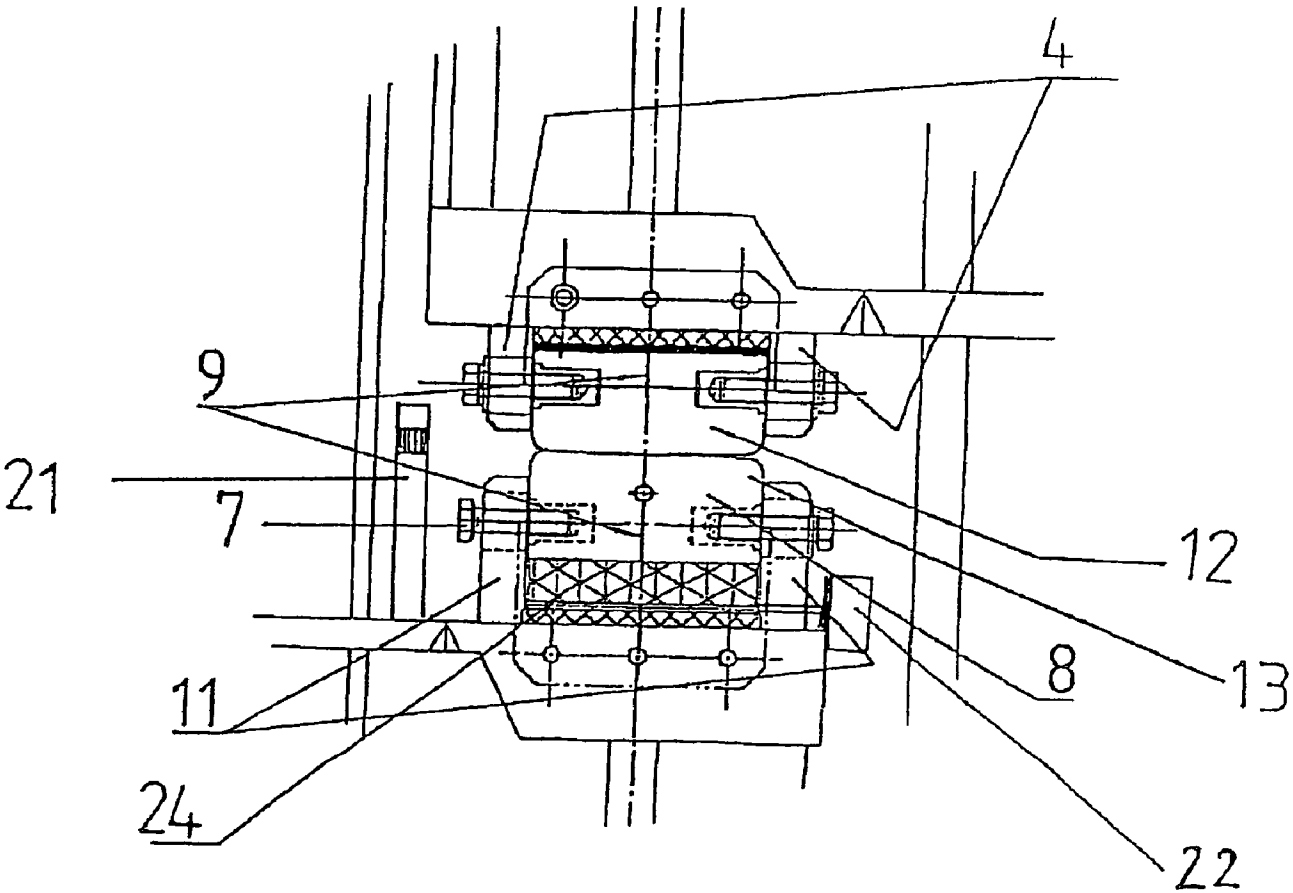
FIG. 9 shows a hydraulic biasing device according to the invention.
Figure 10:
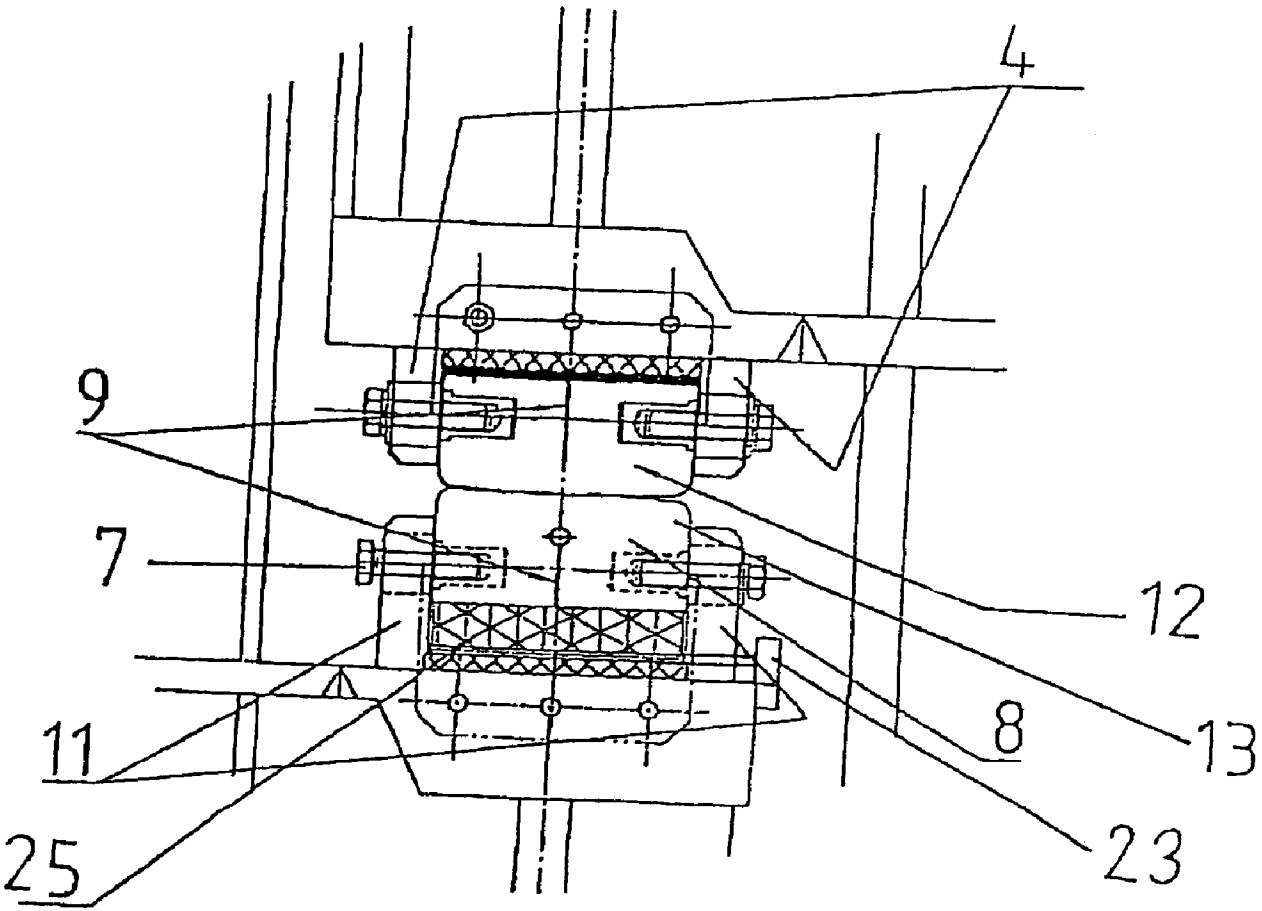
FIG. 10 shows a motor-driven biasing device.

FIG. 6 shows a crane track beam consisting of a fixed travel track part 19 and boom 18, both mounted on support parts, whereby the boom lock is disposed between the two. The production of a biased boom lock will be described verbally using FIG. 6, whereby the example is limited to the use of elastic elements as tension elements. FIG. 9 shows a biasing assembly with hydraulic setting elements. Hydraulic pump 22 pumps hydraulic liquid 24 to create the requisite tension. Alternatively, a motor 23 can be used to drive biasing device 25, as shown in FIG. 10.

Usually, fixed and movable parts of travel track 18, 19 are mounted on support parts (FIG. 6). In this connection, the support parts are disposed in such a manner that the support on the support parts corresponds to the support in the installed state of the travel track.

The fixed part of the travel track is referred to as bridge beam 19, the movable part as boom 18.

Since there is as yet no connection between boom 18 and bridge beam 19, the boom 18 must be additionally supported in the region of the boom joint (support part 20 shown with a broken line). After boom 18 and bridge beam 19 have been oriented (alignment, height position), the bore of the joint pin is marked. Afterwards, the lower bearing point is assembled. In this connection, attention must be paid to ensure that the cylinder surface of the slide plates, in terms of height, is precisely aligned according to the radius to the bearing bore and, in terms of elevation, the center axis of the cylinder is oriented at a right angle to the longitudinal axis of the travel track, and fixed in place with the thrust blocks. It is practical to use usual lining plates and known embedding in an epoxy casting mass for the orientation.

Now, instead of the slide plates, hydraulic presses or wedges or other tools suitable for introducing the bias force are installed in the upper bearing point, and boom and bridge beam are biased relative to one another. The bias force required for this is determined from the greatest vertical force that occurs during operation, plus a safety margin, in order to reliably avoid gaping of the join between the slide plates in the lower bearing during operation.

After boom 18 and bridge beam 19 have been biased, the support part 20 is removed, the ends of the two rails to be joined are precisely oriented, i.e. adapted (grinding or mechanically finished underlay), and the bore for joint pin 3 is spindled out or drilled out using usual means and methods.

Support part 20 is activated again, the bias of the two parts of the travel track is cancelled out, and the slide plates are mounted in the upper bearing point. For this purpose, first the slide plates are laid in, roughly oriented in terms of height with lining plates, precisely oriented in their elevation, and the thrust blocks are installed. Afterwards, the slide plates are removed, the epoxy resin embedding of the lower slide plate is introduced, and thereupon the height of the lower slide plate is adjusted by means of lining plates, in such a manner that the cylinder-shaped surface lies precisely in the radius to the axis of rotation of the joint.

Now the upper slide plate is placed onto the lower one, filled up with lining plates towards the top, and the epoxy resin embedding for the upper slide plate is introduced.

Afterwards, bridge beam 19 and boom 18 are separated, an elastic tension element, e.g. a rubber plate, a superstructure bearing, or the like is introduced below the lower slide plate in the upper bearing, and the slide plate is adjusted to a certain excess dimension, in terms of height, using lining plates.

This excess dimension is determined from the resilience behavior of the tension element and is adjusted in such a manner that the required bias force is produced with the boom 18 in the operating position in the boom lock.

Accordingly, while only a few embodiments of the present invention have been shown and described, it is obvious that many changes and modifications may be made thereunto without departing from the spirit and scope of the invention.

LIST OF REFERENCE SYMBOLS USED

1 crane
2 boom
3 boom joint with pin
4 thrust block (top)
5 thrust block (bottom)
6 trolley
7 screw
8 travel track
9 scribe mark
10 thrust block (top)

11 thrust block (bottom)
12 upper slide plate in the upper bearing point
13 lower slide plate in the upper bearing point
14 spring element
15 thrust block (top)
16 lower slide plate in the lower bearing point
17 upper slide plate in the lower bearing point
18 boom on support part
19 bridge beam on support part
20 additional support part
21 lubricating device
22 hydraulic pump
23 motor
24 hydraulic liquid
25 biasing device

What is claimed is:

1. A biased support for pivoting travel tracks on a boom, comprising:

a pin connected to the boom;

a lock on the boom; and a plurality of slide plates between an upper and lower bearing point of the lock, an upper and a lower of said slide plates being mounted in the upper bearing point, and an upper and a lower slide plate being mounted in the lower bearing point, wherein at least one of the two slide plates in the upper bearing point is mounted elastically, so that when the boom is pivoted into an operating position, the entire lock is biased vertically and the pin is relieved of stress.

2. A support according to claim 1, wherein the upper slide plates in the upper bearing point is mounted elastically.

3. A support according to claim 1, wherein the lower slide plate in the upper bearing point is mounted elastically.

4. A support according to claim 1, wherein the slide plate is mounted elastically via a spring element.

5. A support according to claim 1, wherein the slide plate is mounted elastically via a helical spindle activated by a motor or a hydraulic bias device.

6. A support according to claim 1, wherein each of the upper slide plates have a convex surface in the shape of a cylinder contacting the lower slide plates.

7. A support according to claim 6, wherein a radius of the cylinder is equal to a distance from a center of the pin to a surface of the lower slide plate.

8. A support according to claim 6, wherein the lower slide bearings have a concave surface in the shape of a cylinder for contacting the upper slide bearings, so that surface contact occurs when the upper and lower slide plates touch one another.

9. A support according to claim 1, wherein the slide plates consist of wear-resistant material and have devices for applying lubricants.

* * * * *